US005903795A

United States Patent [19]

Piccinino, Jr. et al.

[11] Patent Number: 5,903,795

[45] Date of Patent: May 11, 1999

[54] PHOTOGRAPHIC PROCESSOR

[75] Inventors: Ralph L. Piccinino, Jr., Rush; John H. Rosenburgh, Hilton, both of N.Y.

[73] Assignee: Eastman Kodak Company, Rochester, N.Y.

[21] Appl. No.: 08/864,234

[22] Filed: May 23, 1997

[51] Int. Cl.[6] ..... G03D 3/02

[52] U.S. Cl. ..... 396/626; 396/627

[58] Field of Search ..... 396/612, 614, 396/619, 636, 626, 620, 627; 430/30, 398–400; 118/200, 244, 251

[56] References Cited

U.S. PATENT DOCUMENTS

| | | | |
|---|---|---|---|
| 4,345,831 | 8/1982 | Kachelries | 396/578 |
| 4,371,250 | 2/1983 | Wakabayashi et al. | 396/627 |
| 4,464,035 | 8/1984 | Schoering | 396/627 |
| 4,740,075 | 4/1988 | Schoernig | 396/614 |
| 4,837,593 | 6/1989 | Hehn | 396/622 |
| 5,140,356 | 8/1992 | Ohba et al. | 266/179 |
| 5,179,404 | 1/1993 | Bartell et al. | 396/617 |
| 5,207,762 | 5/1993 | Newman | 62/419 |
| 5,313,243 | 5/1994 | Rosenburgh et al. | 396/626 |
| 5,349,412 | 9/1994 | Miyasaka | 396/604 |
| 5,353,087 | 10/1994 | Rosenburgh et al. | 396/636 |
| 5,353,088 | 10/1994 | Rosenburgh et al. | 396/626 |
| 5,355,190 | 10/1994 | Rosenburgh et al. | 396/627 |
| 5,381,203 | 1/1995 | Piccinino, Jr. et al. | 396/565 |
| 5,386,261 | 1/1995 | Patton et al. | 396/620 |
| 5,394,216 | 2/1995 | Suzuki et al. | 396/626 |
| 5,398,094 | 3/1995 | Rosenburgh et al. | 396/626 |
| 5,400,106 | 3/1995 | Rosenburgh et al. | 396/626 |
| 5,418,591 | 5/1995 | Rosenburgh et al. | 396/619 |
| 5,420,659 | 5/1995 | Manico et al. | 396/619 |
| 5,481,328 | 1/1996 | Verhoest et al. | 396/626 |

FOREIGN PATENT DOCUMENTS 0 418 757 A2 3/1991 European Pat. Off. .

OTHER PUBLICATIONS

Patent Abstract of Japan Application No. 07052283, Takada Kenji, Photographic Material Processing Device, Mar. 13, 1995.

*Primary Examiner*—D. Rutledge
*Attorney, Agent, or Firm*—Frank Pincelli

[57] ABSTRACT

A photographic processing apparatus and method for processing a photosensitive material. The apparatus comprises a processing tank containing a processing solution through which a photosensitive material is passed for processing. A transport system is provided for transporting of the photosensitive material through the processing solution contained with the tank. The transport system includes at least one transport roller which is partially submerged in the processing solution. The replenishment system includes a dispensing tube for dispensing the replenishment solution directly on the transport roller, such that the replenishment solution is on the roller.

10 Claims, 5 Drawing Sheets

PHOTOGRAPHIC PROCESSOR

FIELD OF THE INVENTION

The present invention relates to the field of photographic processors, in particular, to low volume thin tank type processors.

BACKGROUND OF THE INVENTION

In conventional type photographic processors, the photosensitive material is passed through a series of processing solutions contained in adjacent processing tanks. Each of the processing tanks contain a substantial amount of processing solution that is recirculated through various devices, such as filters, heaters, and pumps. As photosensitive material is processed, certain chemical components are consumed in the processing solution, thereby requiring replenishment of the processing solution. In a typical conventional prior art processor, replenishment of the processing solution is accomplished by the introduction of replenishment solution directly into the processing tank, or into the recirculation system. Often the replenishment solution is diluted such that an amount of processing solution is caused to overflow out of the processing tank. In these systems, cross-over transport rollers are provided for transferring the photosensitive material from one tank to the next adjacent tank. At least some of these cross-over rollers are partially submerged within the processing solution. When the processor is inactive for a period of time, a build-up of undesirable residue may be formed on the cross-over roller. In conventional prior art processors, it has been suggested that this build-up residue may be cleaned by allowing water to be poured on the roller. This is particularly important during initial start-up of the processor at the beginning of the day. Because of the large amount of processing amount solution contained in typical prior art processors, the addition of this water does not substantially affect the processing solution therein. In certain processors the cross-over rollers are taken out for cleaning.

Recently there has been suggested the use of low volume thin tank type processors. U.S. Pat. Nos. 5,270,762; 5,353,088; 5,400,106; 5,420,659; 5,355,190; 5,398,094; 5,313,243; 5,418,591; 5,347,327; 5,386,261; 5,381,203; 5,353,087 illustrate thin tank processors wherein a photosensitive material is passed through a narrow processing channel. The processing channel has a generally U-shaped configuration comprising a first generally arcuate entrance section, a generally straight processing section, and a generally arcuate exit section. A nozzle is typically provided in the narrow processing channel for impinging a processing solution onto the photosensitive material as it passes through the processing channel. The processor is designed to process individual sheets and/or a continuous web.

In the foregoing low volume thin tank processor, minimal amounts of processing solution is provided in each of the processing sections. However, it is still necessary that the cross-over rollers be cleaned after a long period of non-use, for example, during overnight periods when the processor is not used. Unfortunately, the operators often are negligent, or are too busy to take out the rollers for appropriate cleaning. Additionally, in low volume thin tank processors, it is not desirable to wash the rollers while they are in the tank as this would substantially dilute the processing solution contained within the processing section to undesirable levels. Quite often, in a low volume thin tank processor, this could dilute processing solution by up to 10% as opposed to 1% for conventional-type processors.

Thus, there is a need in low volume thin tank processors to provide means that is convenient and easy to use for the operator to clean these rollers without unnecessarily diluting of the processing solution contained in the processing tank.

The present invention solves the foregoing problem by providing a replenishment system for dispensing replenishment solution directly along the transport rollers which are used for transporting of the photosensitive material.

SUMMARY OF THE INVENTION

In accordance with the present invention, there is provided a photographic processing apparatus for processing the photosensitive material. The apparatus comprises a processing tank containing a processing solution through which a photosensitive material is passed for processing. A transport system is provided for transporting of the photosensitive material through the processing solution contained with the tank. The transport system includes at least one transport roller which is partially submerged in the processing solution. The replenishment system includes a dispensing tube for dispensing the replenishment solution directly on the transport roller, such that the replenishment solution is on the roller.

BRIEF DESCRIPTION OF THE DRAWINGS

Other objects, advantages and features of the present invention will become apparent from the following specification when taken in conjunction with the drawings in which like elements are commonly enumerated, and in which.

DETAILED DESCRIPTION OF THE INVENTION

Figure 1:
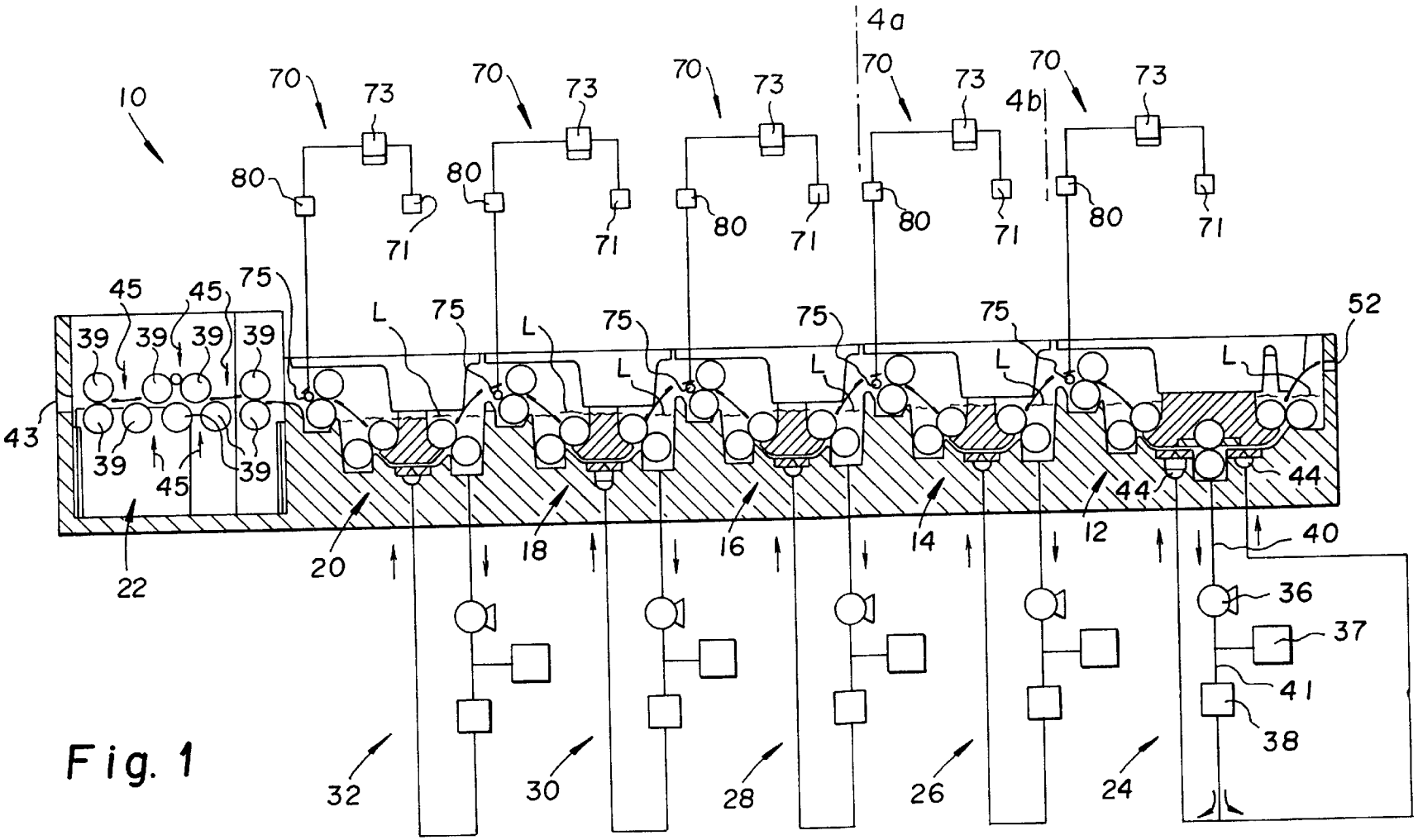
FIG. 1 is a schematic view of a processing apparatus made in accordance with the present invention.
Figure 2:
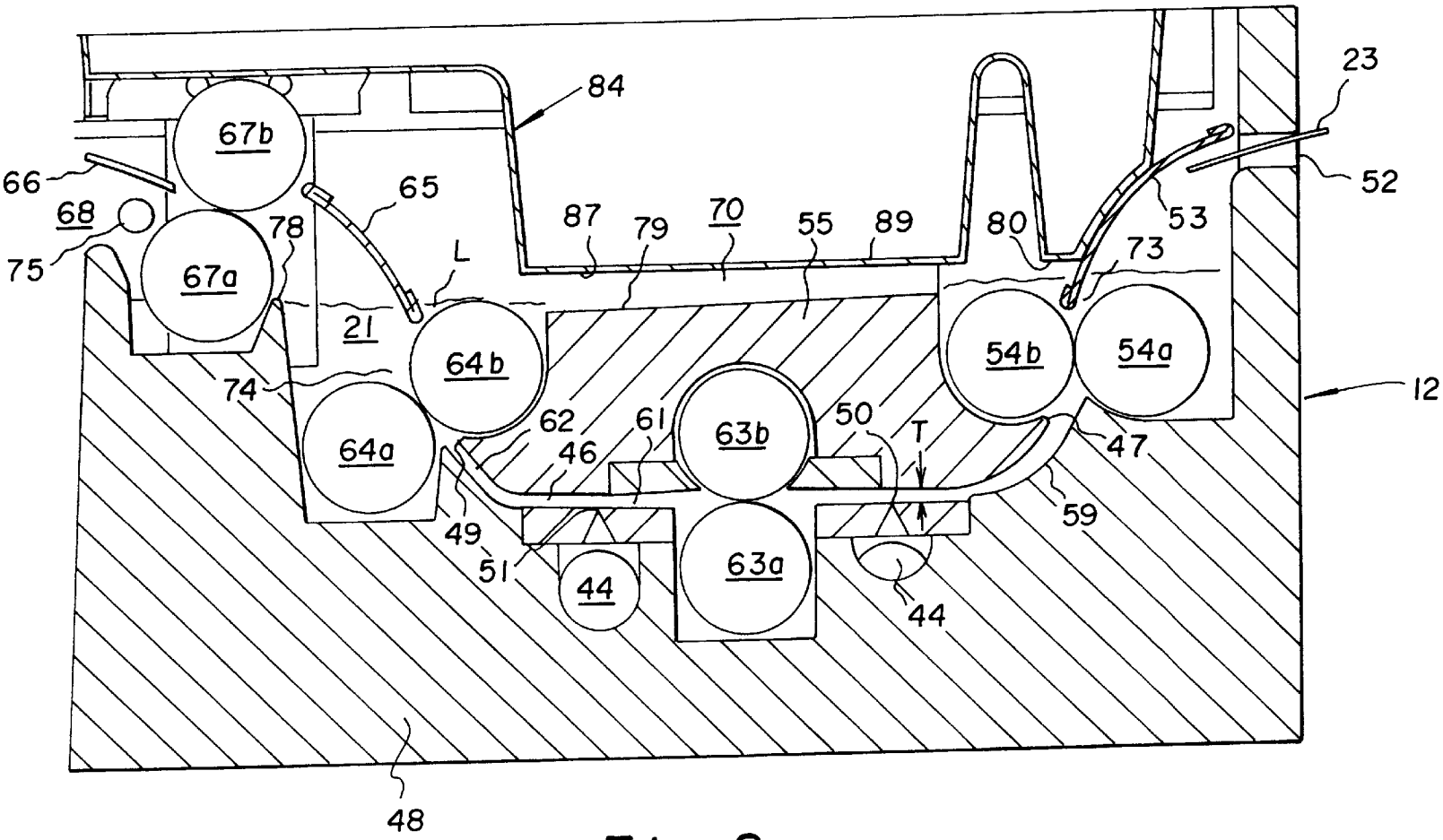
FIG. 2 is an enlarged cross-sectional view of the developing section of the processing apparatus of FIG. 1 illustrating the processing channel for processing of photosensitive material.
Figure 3:
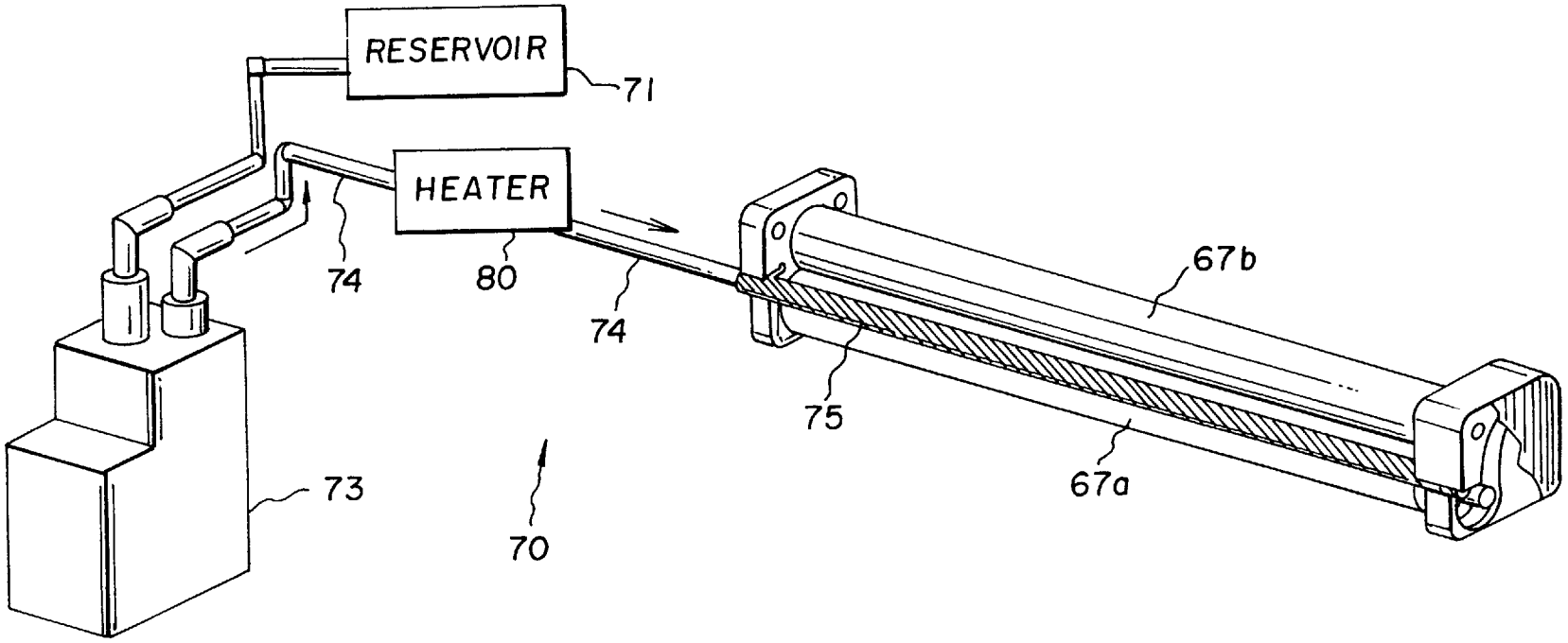
FIG. 3 is a partial perspective view of the replenishment system and the dispensing tube of the apparatus of FIG. 1.
Figure 4:
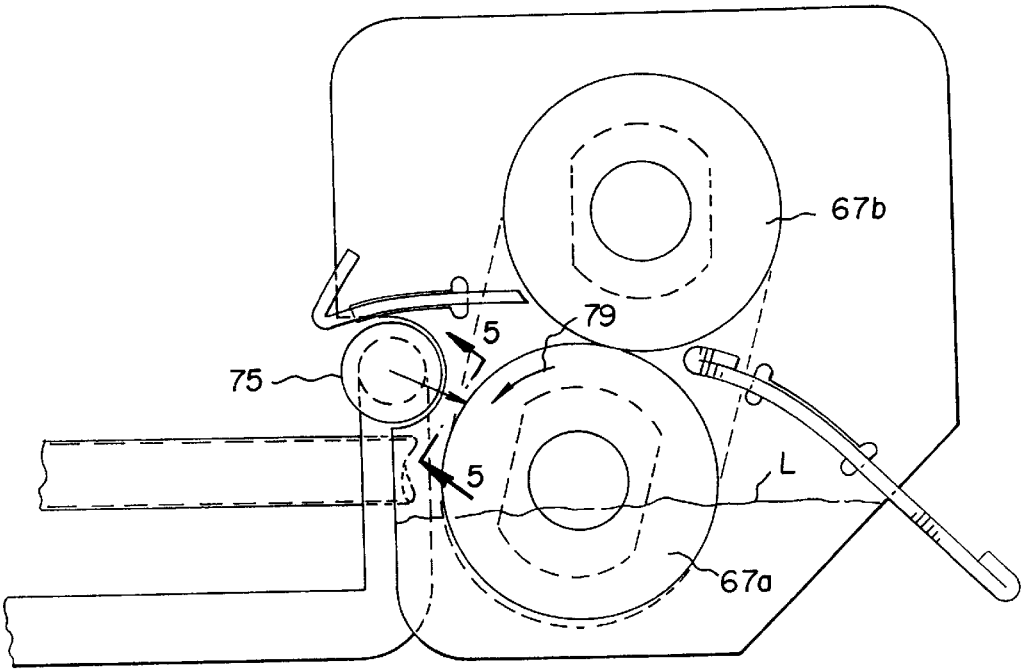
FIG. 4 is a greatly enlarged partial view of the transport rollers of FIG. 2 illustrating the dispensing tube made in accordance with the present invention.
Figure 5:
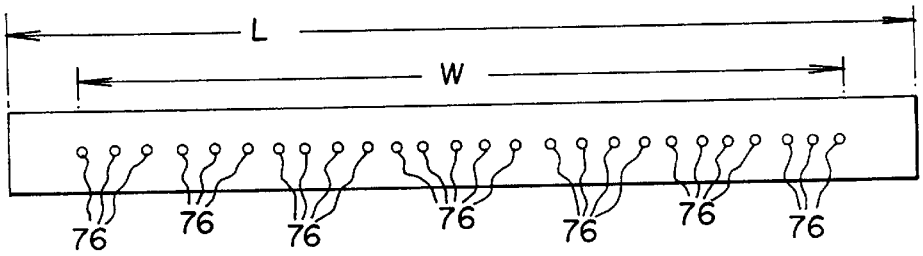
FIG. 5 is an elevational view of the tube as taken along line 5—5 of FIG. 4.
Figure 6:
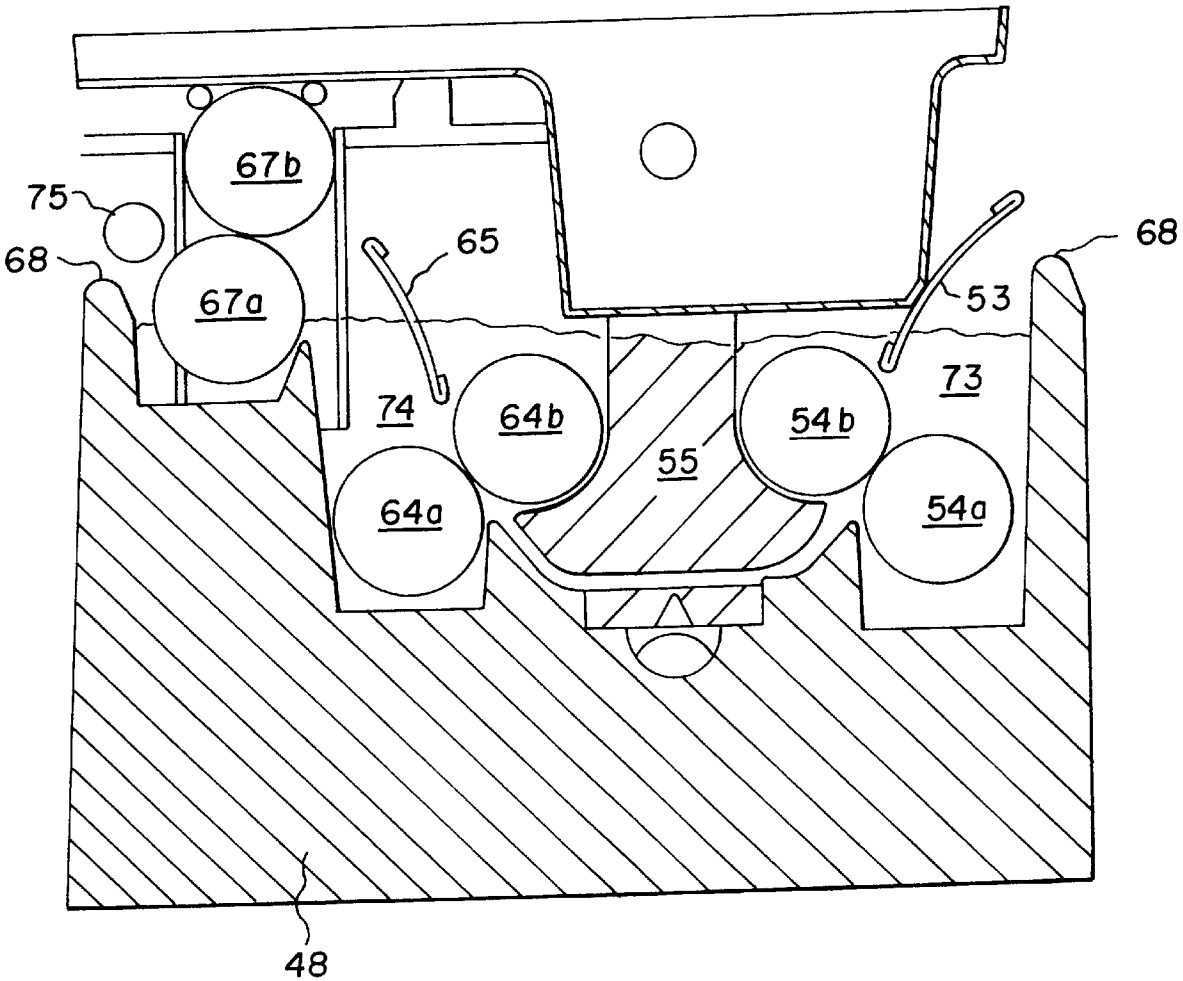
FIG. 6 is an enlarged cross-sectional view of a second processed section of the processing apparatus of FIG. 1 illustrating the dispensing tube made in accordance with the present invention.

Referring to FIGS. 1 and 2, there is illustrated a processing apparatus 10 made in accordance with the present invention. The apparatus includes a plurality of processing sections 12,14,16,18,20, each processing section being designed to hold a processing solution 21 for processing a photosensitive material 23 (see FIG. 4) passing therethrough. In the particular embodiment illustrated, processing section 12 contains a developing processing solution; section 14 contains a bleach-fixing processing solution; and sections 16,18,20 each contain a stabilizer wash processing solution. The level of the processing solution for each of the processing sections is indicated by the letter L. A dryer 22 is provided for drying of the photosensitive material 23 after it has exited the last processing section 20.

The dryer 22 includes a plurality of rollers 39 for guiding and transporting of the photosensitive material 23 through the dryer 22. An appropriate mechanism, as is well known in the art, is provided for providing drying air against the photosensitive material 23, as indicated by arrows 45, as it passes through the dryer 22 such that the photosensitive material is substantially dry as it exits the apparatus 10 through exit opening 43.

Recirculation systems 24,26,28,30,32 are provided for recirculating processing solution through each of the processing sections 12,14,16,18,20, respectively. Each of the recirculation systems 24,26,28,30,32 are substantially identical in construction, like numerals indicating like parts and operation. Therefore, only recirculation system 24 will be discussed in detail, it being understood that the remaining recirculation systems are substantially identical in construction and operation.

The recirculation system 24 obtains processing solution from outlet 34 which is fluidly connected to pump 36 by conduit 40. Processing solution is recirculated by pump 36 through a filter 38 through conduit 41. The processing solution leaves filter 38 through conduit 42 and is supplied to the inlet 44 of the processing section 12.

Referring to FIG. 2, there is illustrated in greater detail the processing section 12. The processing section 12 is designed to be of the low volume thin tank type. In particular, a narrow processing channel 46 having an inlet 47 and outlet 49 is provided through which the photosensitive material 23 passes for processing. The processing channel 46 has a substantially constant thickness T along its length. The processing channel 46, for a processor for processing photographic paper, preferably has a thickness T equal to or less than 50 times the paper thickness, preferably a thickness T equal to or less than about 10 times the thickness of the photographic paper. In a processor for processing photographic film, the thickness T should be equal to or less than about 100 times the thickness of the film, preferably equal to or less than about 18 times the thickness of the film.

The processing section 12, as previously discussed, is of the low volume type, that is, the total amount of processed solution contained in the processing section 12 accounts for at least 40% of the total volume of the processing solution available, that is, the processing solution available in the processing section 12 and the recirculation system 24. Preferably, the volume of the processing solution in processing section 12 is at least 50% of the total volume of available processing solution. In the particular embodiment illustrated, the volume of the processing solution in the processing section 12 is approximately 60% of the total volume of processing solution available. The processing section 12 is designed such that there is very little excess area or volume in which the processing solution 21 may reside outside of the processing channel 46. Where possible, the appropriate parts are configured to closely conform to any rollers or other items placed therein.

In the embodiment illustrated, processing section 12 includes a pair of nozzles 50,51 for introducing processing solution 21 from inlet 44 into the processing channel 46 against the side of the photosensitive material 23 having the photosensitive emulsion. The processing solution 21 is introduced so as to impinge against the photosensitive material 23, preferably with a sufficient degree of force so as introduce fresh processing solution to the surface of the photosensitive material 23. In particular, each of the processing nozzles 50,51 comprise an elongated narrow continuous slot which extends across the width of the processing material passing through the processing channel 46.

In order to provide efficient flow of processing solution through the nozzles 50,51, it is desirable for each of the nozzles 50,51 to deliver processing solution to the processing channel 46 in accordance with the following relationship:

$$1<F/A<40$$

wherein:

F is the flow rate of the solution through the nozzle in gallons per minute; and A is the cross-sectional area of the nozzle provided in square inches.

Providing slot nozzles in accordance with the foregoing relationship assures appropriate discharge of processed solution against the photosensitive material.

Photosensitive material 23 enters the processing section 12 through opening 52 and is guided by guide plate 53 to a pair of entrance rollers 54.

As can be seen, the processing channel 46 has a generally U-shaped overall configuration wherein photosensitive material enters a first generally arcuate section 59 through inlet 47 and then passes through a generally straight section 61 where the nozzles 50,51 are located, and then through a generally arcuate exit section 62 wherein the photosensitive material 23 passes out of the outlet 49 of the processing channel 46. In the embodiment illustrated, the straight section 61 extends in a substantially horizontal direction. When the photosensitive material travels in a horizontal direction, the force of gravity contributes to the potential jamming of the photosensitive material.

A second, third and fourth pair of guide/transport rollers 63*a* and 63*b*, 64*a* and 64*b*, and 67*a* and 67*b* are provided for guiding and/or transporting of the photosensitive material 23. In particular, the pair of rollers 63*a*,63*b* guide the photosensitive material 23 in the straight section 61 of the processing channel 46, and rollers 64*a*,64*b* guide the photosensitive material 23 as it passes outlet 49 of the processing channel 46. A guide plate 66 is provided for guiding of the photosensitive material 23 out of outlet 68 of the processing section 12 onto the next processing section, which in the present embodiment is processing section 14.

As illustrated by FIG. 2, the processing channel 46 is formed by lower block assembly 48 and upper block member 55, the nozzles 50,51 being incorporated into the lower block assembly 48. It is to be understood that the nozzles 50,51 may be incorporated in the upper block member 55, or both the upper block member and lower block assembly as desired. As previously discussed, the processing section 12 is designed to hold a minimal amount of processing solution 21. The shape of the block members 48,55 are such that an entrance fluid retention area 73 is provided adjacent the inlet 47 of the processing channel 46 and a fluid retention area 74 is formed adjacent the outlet 49 of processing channel 46. A weir 78 is provided for allowing excess processing solution to pass out of the processing section 12. In particular, the weir 78 is disposed for direct fluid communication with fluid retention area 74.

A cover 84 is provided with a surface 87 which is designed to engage the upper surface 89 of the block member 48 and the adjacent processing solution 21 when it rises to the level of the cover 84. The cover 84 assists in minimizing oxidation of the processing solution 21 and protects the processing solution from external contamination.

A replenishment system 70 is provided for each of the processing sections 12,14,16,18,20. Referring to FIGS. 1, 3, 4, and 5, the replenishment system includes a reservoir 71 in which replenishment solution is contained. The replenishment solution is pumped from reservoir 71 by pump 73 through conduit 74 to dispensing tube 75, which is disposed adjacent roller 67*a*. The tube 75 has a length L, which preferably extends across the length of the roller 67*a*, and is provided with a plurality of individual outlets/openings 76 for directing of the replenishment solution directly onto the surface of the roller 67*a*, which is partially submerged in the processing solution contained in the processing tank. Preferably, as illustrated, the tube 75 is disposed on the side of the roller 67*a* that will be entering the processing solution contained within the processing section. Thus, as can be seen, the roller 67*a* rotates in a direction indicated by arrow 79, thus causing the replenishment solution to be directed to the processing solution. This allows for a good mixing of the replenishment solution with the processing solution already contained in the processing tank, thus minimizing or avoiding chemical concentration areas. The replenishment solution also serves the purpose of cleaning the rollers 67*a*,67*b*. The fresh replenishment solution supplied serves as a mechanism for preventing the formation of residue that may build up on the rollers.

In the preferred embodiment, a plurality of substantially equally spaced outlets 76 are illustrated. In place of the spaced outlets 76, a single continuous slot or a plurality of individual slots may be placed along the length of the tube 75 as desired. The openings and/or slots are preferably designed so as to provide a substantially uniform application of replenishment solution across roller 67*a*, preferably at least in the area the photosensitive material passes, that is, across the width W of the photosensitive material.

Preferably, the replenishment solution is of an appropriate concentration of replenishment solution provided such that a relatively low amount of volume is added to the processing tank. This is of particular importance in a low volume thin tank processor of the type illustrated herein.

As can be seen, the replenishment solution is supplied directly into the processing tank. If necessary, the replenishment solution may be preheated by a heater 80 placed in conduit 74 (see FIG. 3). Due to the relatively low amount of processing solution provided in the processing tank and recirculation system of the processing section made in accordance with the present invention, it is desirable not to adversely affect the temperature of the processing solution within the processing section. Therefore, the temperature of the processing solution in the processing tank can be monitored and the heater adjusted such that the process of replenishment solution exiting out of the tube 75 will be substantially the same as the processing solution within the processing tank. However, if the temperature of the processing solution within the tank is either too high, the replenishment solution can be cooled as appropriate.

Thus, as it can be seen, there is provided an apparatus whereby the transfer rollers are used for transferring of photosensitive material from one processing tank to another, while at the same time providing the appropriate replenishment and without requiring any unnecessary operator task, such as removing the rollers. Additionally, the present invention avoids the providing of excess processing solution which can dilute and adversely affect the low volume processing system of the present invention.

The invention has been described in detail with particular reference to certain preferred embodiments thereof, but it will be understood that variations and modifications can be effected within the spirit and scope of the invention.

PARTS LIST

| | |
|---|---|
| 10 | apparatus |
| 12,14,16,18,20 | processing sections |
| 21 | processing solution |
| 22 | dryer |
| 23 | photosensitive material |
| 24,26,28,30,32 | recirculation systems |
| 34 | outlet |
| 36 | pump |
| 38 | filter |
| 39 | rollers |
| 40,41,42 | conduit |
| 43 | exit opening |
| 44 | inlet |
| 45 | arrows |
| 46 | processing channel |
| 47 | inlet |
| 48 | lower block assembly |
| 49 | outlet |
| 50,51 | nozzles |
| 52 | opening |
| 53 | guide plate |
| 54 | entrance rollers |
| 55 | upper block member |
| 59 | arcuate section |
| 61 | straight section |
| 62 | exit section |
| 63a,63b | guide/transport rollers |
| 64a,64b | guide/transport rollers |
| 66 | guide plate |
| 67a,67b | guide/transport rollers |
| 68 | outlet |
| 70 | replenishment system |
| 71 | reservoir |
| 73 | pump |
| 74 | conduit |
| 75 | dispensing tube |
| 76 | outlets/openings |
| 78 | weir |
| 79 | arrow |
| 80 | heater |
| 84 | cover |
| 87 | surface |
| 89 | upper surface |

What is claimed is:

1. A photographic processing apparatus for processing a photosensitive material, comprising:

a processing tank containing a processing solution through which a photosensitive material is passed for processing thereof;

a transport system for transporting of the photosensitive material through said processing solution contained within the tank, said transport system comprising at least one transport roller which is partially submerged in said processing solution;

a replenishment system for dispensing a replenishment solution for replenishing a chemical constituent of said processing solution, said replenishment system having a dispensing tube for dispensing of the replenishment solution, said dispensing tube being positioned adjacent said at least one transport roller and having an outlet disposed such that the replenishment solution is directed to said at least one transport roller.

2. An apparatus according to claim 1 wherein said outlet is disposed on the side of said at least one transport roller which will be entering the processing solution.

3. An apparatus according to claim 1 wherein said outlet comprises a plurality of individual openings disposed along the length of said at least one transport roller.

4. An apparatus according to claim 1 wherein said outlet comprises at least one or more continuous slots which extend across at least the width of the photosensitive material passing thereby.

5. A method of supplying a replenishment solution to a photographic processor having a processing tank containing a processing solution through which a photosensitive material is passed for processing thereof and a transport system for transporting of the photosensitive material through said processing solution contained within the tank, said transport system comprising at least one transport roller which is partially submerged in said processing solution, said method comprising the steps of:

supplying the replenishment solution for replenishing a chemical constituent of said processing solution directly on said at least one roller which is partially submerged in said processing solution.

6. A method according to claim 5 wherein replenishment solution is provided in a substantially uniform manner across said at least one roller at least in the area in which said photosensitive material passes.

7. A method according to claim 6 wherein a dispensing tube is provided adjacent said at least one partially submerged roller and on the side which said roller enters the processing solution in said tank.

8. A method according to claim 6 wherein a dispensing tube is provided for dispensing said replenishment solution.

9. A method according to claim 8 wherein said dispensing tube is provided with a plurality of substantially equally spaced openings.

10. A method according to claim 8 wherein said dispensing tube is provided with a continuous slot which extends along said partially submerged roller.

* * * * *